United States Patent [19]

Eftefield et al.

[11] Patent Number: 4,560,207

[45] Date of Patent: Dec. 24, 1985

[54] METHOD AND APPARATUS FOR FRAGMENTING ASPHALT

[75] Inventors: Larry G. Eftefield, Edelstein; Gerald P. Simmons, Morton; Gregory L. Stone, Peoria, all of Ill.

[73] Assignee: Caterpillar Tractor Co., Peoria, Ill.

[21] Appl. No.: 585,051

[22] Filed: Mar. 1, 1984

[51] Int. Cl.[4] ..... E21C 37/00

[52] U.S. Cl. ..... 299/10; 299/36; 299/64; 241/101.7; 241/187

[58] Field of Search ..... 299/10, 36, 37, 39, 299/64; 198/510, 512, 628; 404/75, 77, 90, 91; 241/101.7, 187, 186 R, 186.4

[56] References Cited

U.S. PATENT DOCUMENTS

| | | | |
|---|---|---|---|
| 2,768,794 | 10/1956 | Putnam | 299/36 |
| 3,133,730 | 5/1964 | Cornett | 262/14 |
| 3,272,559 | 9/1966 | Haynes | 299/37 |
| 3,307,680 | 3/1967 | Luedtke | 198/628 |
| 3,598,027 | 8/1971 | Swisher, Jr. | 94/22 |
| 3,614,163 | 10/1971 | Anderson | 299/14 |
| 3,778,109 | 12/1973 | Anderson et al. | 299/14 |
| 3,803,983 | 4/1974 | Amtsberg | 91/227 |
| 3,892,279 | 7/1975 | Amtsberg | 173/13 |
| 3,907,450 | 9/1975 | Cutler | 404/90 |
| 4,074,858 | 2/1978 | Burns et al. | 239/172 |
| 4,139,318 | 2/1979 | Jakob et al. | 404/90 |
| 4,140,420 | 2/1979 | Swisher, Jr. | 404/84 |
| 4,186,968 | 2/1980 | Barton | 299/39 |
| 4,213,719 | 7/1980 | Swisher, Jr. et al. | 404/84 |
| 4,221,434 | 9/1980 | Swisher, Jr. et al. | 299/39 |
| 4,229,109 | 10/1980 | Benson | 366/24 |
| 4,374,602 | 2/1983 | Gurries et al. | 299/37 |
| 4,418,872 | 12/1983 | Nelson | 241/101.7 |

FOREIGN PATENT DOCUMENTS

| | | | |
|---|---|---|---|
| 886015 | 7/1949 | Fed. Rep. of Germany | 299/36 |
| 2208907 | 9/1973 | Fed. Rep. of Germany | 299/36 |

*Primary Examiner*—James A. Leppink
*Assistant Examiner*—M. Goodwin
*Attorney, Agent, or Firm*—Joseph W. Keen

[57] ABSTRACT

A method and apparatus for laterally severing an asphalt layer to form a ribbon, separating the asphalt ribbon from an underlying base, elevating the separated asphalt ribbon, and fracturing the elevated asphalt ribbon by bending same. A cutting member having a leading edge which is insertable between the asphalt ribbon and base provides separation thereof along a lateral line. A ramp and elevating structure elevatingly guide the separated asphalt ribbon into a pair of breaker drums which are rotatable in opposite circumferential directions. Each breaker drum has protruding teeth which are arranged in laterally separated circumferential rows with the teeth in adjacent circumferential rows being preferably arcuately offset. Corresponding circumferential rows on the opposed breaker drums are laterally aligned and the teeth in those rows engage opposite surfaces of the asphalt ribbon during rotation of the breaker drums. The teeth in corresponding rows on the respective breaker drums alternately engage opposite surfaces of the asphalt ribbon at longitudinally spaced locations to bend and fracture the asphalt ribbon by displacing it in generally opposite transverse directions at the engaged locations.

19 Claims, 7 Drawing Figures

METHOD AND APPARATUS FOR FRAGMENTING ASPHALT

DESCRIPTION

1. Technical Field

As used herein "asphalt" refers to a mixture of aggregate and asphalt cement. This invention relates to removal of asphalt from road surfaces, and more particularly, to a method and apparatus for stripping an asphalt layer from a base layer and fragmenting the separated asphalt layer.

2. Background Art

Many miles of improved, asphalt surfaced roads have been built throughout the world. Depending upon usage density, base conditions, temperature and moisture variations, and physical age, the asphalt surface eventually becomes non-planar, unable to support wheel loads and, to varying degrees, becomes unuseable by vehicular traffic.

Delay in refurbishing a road's deteriorated asphalt surface can adversely effect the underlying base and necessitate repair thereof in addition to refurbishing the road's surface. In some cases, a new layer of asphalt may be deposited on the old asphalt surface to regain the smooth, planar surface suitable for vehicular movement. Unless the overlay is made relatively thick, discontinuities existing in the old surface will often reappear, after a short time, in the new asphalt layer. In cases such as bridges, the additional weight of another asphalt layer may be prohibited by the structural strength designed into the bridge. In other cases, simply depositing an additional asphalt layer on top of that already existing may be undesirable for reasons such as the road surface becoming higher than the bounding curbs or the height differential between the road surface and shoulder becoming too great.

Of course, deposition of new asphalt either on top of or in place of an already existing layer results in substantial expenditures in time and money. By blending a relatively small quantity of about 10–50% (depending on type of recycling plant used) of new materials such as binder, aggregate, etc. with the spent asphalt, the resulting mixture can be used to resurface roads at a substantial cost reduction as compared to resurfacing a road with all new materials. Consequently, recent efforts at road rehabilitation have focused on removing the spent asphalt, mixing it with sufficient new binder, aggregate, and other components that were deficient in the original mix or in the spent asphalt and depositing it again.

Numerous techniques for fracturing and/or removing the spent asphalt have been developed and include planing or profile milling of the road surface, breaking the asphalt surface with ripper devices, softening the pavement with infrared heaters and subsequent scarifying, sonic fragmenting, reciprocating hydraulic or diesel hammers, and high pressure pulsed fluid streams for fracturing the asphalt. Examples of road planing are U.S. Pat. Nos. 4,186,968, 4,139,318, 4,221,434, 4,213,719, 4,140,420, and 3,598,027 having respective inventors and issue dates of Barton on Feb. 5, 1980; Jakob et al. on Feb. 13, 1979; Swisher et al. on Sept. 9, 1980, Swisher et al. on July 22, 1980, Swisher et al. on Feb. 20, 1979; and Swisher on Aug. 10, 1971. Examples of ripper or scarifier apparatus are U.S. Pat. Nos. 3,907,450 by Cutler issued on Sept. 23, 1975 and 4,374,602 by Guries et al. issued on Feb. 22, 1983. Examples of sonic fragmenting include U.S. Pat. Nos. 3,614,163 by Anderson issued on Oct. 19, 1971 and 3,778,109 by Anderson et al. issued on Dec. 11, 1973. Examples of reciprocating hydraulic or diesel hammers include U.S. Pat. Nos. 3,892,279 by Amtsburg issued on July 1, 1975, 3,803,983 by Amtsburg issued on Apr. 16, 1974, and 3,133,730 by Cornett issued on May 19, 1964. An example of a high pressure pulsed fluid stream fracturing apparatus is U.S. Pat. No. 4,074,858 by Burns et al. issued on Feb. 21, 1978.

Planing or profile milling apparatus are versatile in that an asphalt layer or any fractional part thereof may be removed from a road surface, but the milling, shearing, grinding action inherent therein results in high wear for the milling head teeth and teeth holders, consumes high horsepower, provides a small fragment size, and produces a substantial percentage of fine material to which additional, larger sized aggregate may need to be added in order to recycle and redeposit an asphalt layer having characteristics similar to that of the removed asphalt. Moreover, if the removed asphalt fragments are to be stored rather than immediately redeposited, an increase in the fragment size becomes desirable to reduce the oxidation rate of the asphalt binder.

The ripper and scarifier apparatus are also effective but require multiple passes and result in irregularly shaped and non-uniformly sized asphalt chunks. Several implements (ripper, loader, etc.) are required and a certain amount of implement congestion on the job site is unavoidable. Additionally, the asphalt fragments which lay on the base and are irregularly shaped and sized are difficult to load while maintaining segregation thereof from debris residing in the base, are not conducive to high loading rates due to the presence of inter-fragment voids, and must be processed further to better uniformalize and reduce the size thereof preparatory to introducing them into a paving mixture processing machine as illustrated in U.S. Pat. No. 4,229,109 by Benson issued on Oct. 21, 1980.

Microwave heating and accoustic fracture are useful in some applications but, in general, are not believed to be economically competitive with more conventional asphalt removal techniques. Hydraulic and diesel hammers again rely on shearing or compressive type fracture which are very efficient fracturing devices but require devices for loading the fractured asphalt for transport and other devices for uniformalizing the fragments in order to have a practical system. High pressure pulsed fluid fracturing techniques and apparatus are generally more suitable for use in cutting narrow strips or lines and are thought to be less effective as compared with milling machines.

A further consideration for selecting an apparatus for fracturing the asphalt from asphalt roadways is the speed with which the process may be accomplished since during the fracture and removal of the asphalt, vehicular traffic over that portion of the roadway must be diverted or interrupted causing substantial increases in travel time and inconvenience for the drivers traveling on that road. Accordingly, the present invention is intended to overcome the aforementioned disadvantages.

DISCLOSURE OF THE INVENTION

In accordance with the present invention, an apparatus is provided which strips away an asphalt layer from an underlying base and fractures the stripped asphalt layer into fragments of desired size. The invention generally includes an apparatus for inserting between and separating the asphalt layer and the base and a fragmenter device which bends the separated asphalt layer until it fractures. In another aspect of the invention a method is described for stripping an asphalt layer away from an underlying base and fracturing the stripped away asphalt layer into fragments of a size compatable with recycling or base material specifications. Such method generally includes moving a separation device along the interface between the asphalt layer and base, lifting the stripped asphalt layer to a desired height, and bending the separated asphalt layer until fracture thereof occurs. Inasmuch as asphalt is weak in bending (tension), the bending failure mode for fragmenting the asphalt conserves energy and minimizes wear of the utilizing apparatus while providing asphalt fragments more conducive to stock piling than fragments produced by mill-profiler type machines having comparable production rates of asphalt removal.

BRIEF DESCRIPTION OF THE DRAWINGS

The advantages of the present invention will become apparent from the following description when read in conjunction with the accompanying drawings in which.

BEST MODE FOR CARRYING OUT THE INVENTION

Figure 1:
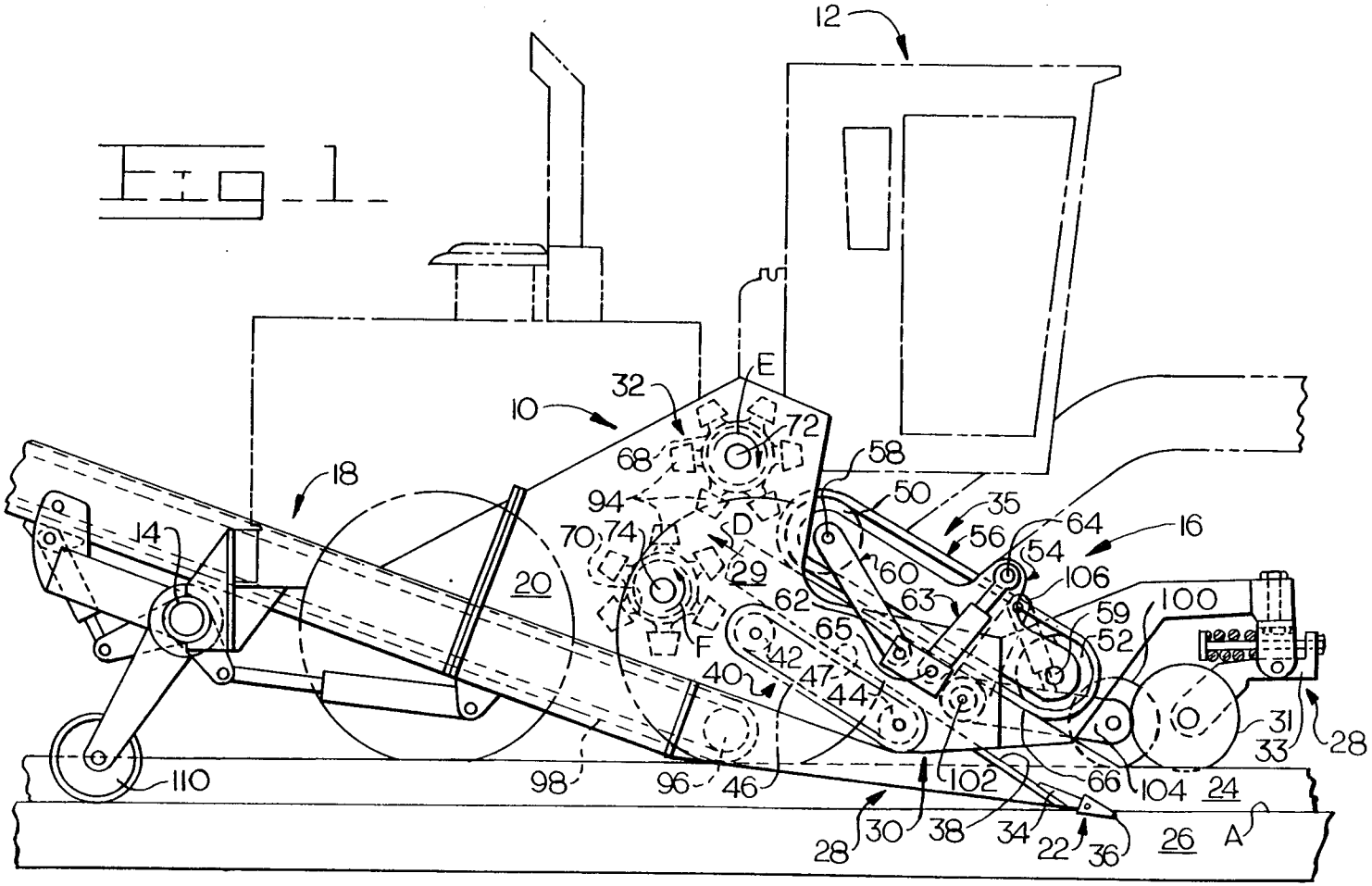
FIG. 1 is a partial side elevation view of a motor grader vehicle and an asphalt processor.

With reference to FIG. 1, longitudinal, lateral and transverse directions will be understood to mean generally horizontal, into and out of the plane of FIG. 1, and perpendicular to a reference surface or object, respectively.

Referring now to the drawings in detail, FIG. 1 illustrates an asphalt processor 10 which is, by example, mounted on a motor grader vehicle 12 through a large diameter support tube 14. The asphalt processor 10 includes a fragmenter apparatus 16 and an elevating conveyor structure 18 mounted on a common main frame 20 which is joined to the support tube 14.

The asphalt fragmenter 16 generally includes means 22 for separating an asphalt layer 24 from its underlying base 26 by severing the attachment bond therebetween, means 28 (also shown in FIG. 2) for cutting the asphalt layer 24 at a lateral location to define an asphalt ribbon 29, means such as support structure 30 for elevating the asphalt ribbon 29 after separation from the base 26, and breaker means 32 for bending and fracturing the stripped and uplifted asphalt ribbon 29 into fragments of predetermined size.

Figure 2:
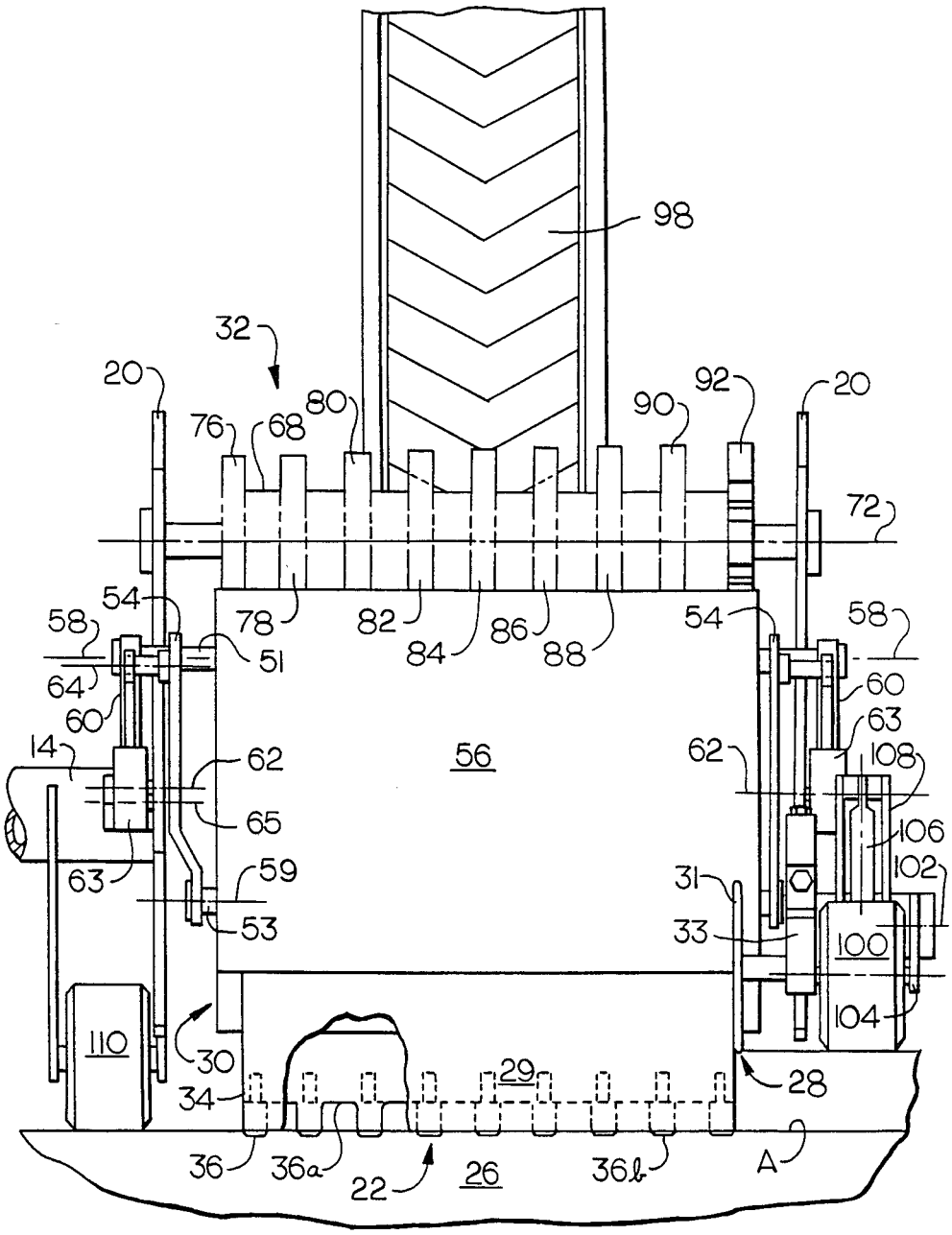
FIG. 2 is a front elevation view of the asphalt processor of FIG. 1.

The separating means 22 includes a separation member 34 which is secured to the support structure 30 and which has a leading edge 36 that is insertable between the asphalt and base layers 24 and 26 for separating same when the cutting member is drawn or pushed along the interface "A" between the layers. The leading edge 36 has a serrated shape, as best illustrated in FIG. 2, with alternating longitudinal recesses **36*a* and longitudinal extensions 36*b*. The cutting means 28 preferably includes a coulter 31 which is rotatably supported on the far side (as illustrated in FIG. 1) of the main frame 20 in "caster like" fashion by an arm 33 attached to the main frame 20. For thick or very hard asphalt, a saw having carbide teeth may be substituted for the coulter 31**.

The uplifting, support structure 30 has a ramp surface 38 joined to the frame 20 for raising the separated asphalt ribbon 29 and an elevating structure 40 longitudinally following the ramp surface 38. The elevating structure 40 includes a pair of generally cylindrical, longitudinally separated, cog members 42 and 44 which are rotatably supported on the frame 20 and about which an endless track 46 is entrained and coupled. The endless track 46 has a support surface 47 which is inclined between the cog members 42 and 44 to angularly cooperate with the ramp surface 38 to transport the asphalt ribbon 29 to a predetermined height. The upper, longitudinally rearwardly arranged cog member 42 preferably constitutes a driver which, when rotated, provides belt movement about the cog members 42 and 44. The support structure 30 further includes a constraining structure 35 which has a trailing, rotatable roller 50, a leading rotatable roller 52, a constraining frame 54, and an endless belt 56 entrained about and coupled to the rollers 50,52. The rollers 50 and 52 have respective shafts 51 and 53 and are rotatably supported on the constraining frame 54 about respective axes 58 and 59. A pair of pivot arms 60 respectively arranged on the near and far lateral sides of the constraining frame 54 each have opposite ends pivotally connected to the main frame 20 about an axis 62 and to the shaft 51 about the axis 58. A pair of hydraulic cylinders 63 arranged on opposite lateral sides of the constraining frame 54 each have one end pivotably mounted to the constraining frame 54 about an axis 64 and the other end pivotably mounted to the main frame 20 about an axis 65. The endless belt 56 has a constraining surface 66 which is biased toward the support surface 47 by the hydraulic cylinders 64 and is generally parallel to the support surface 47.

Figure 3:
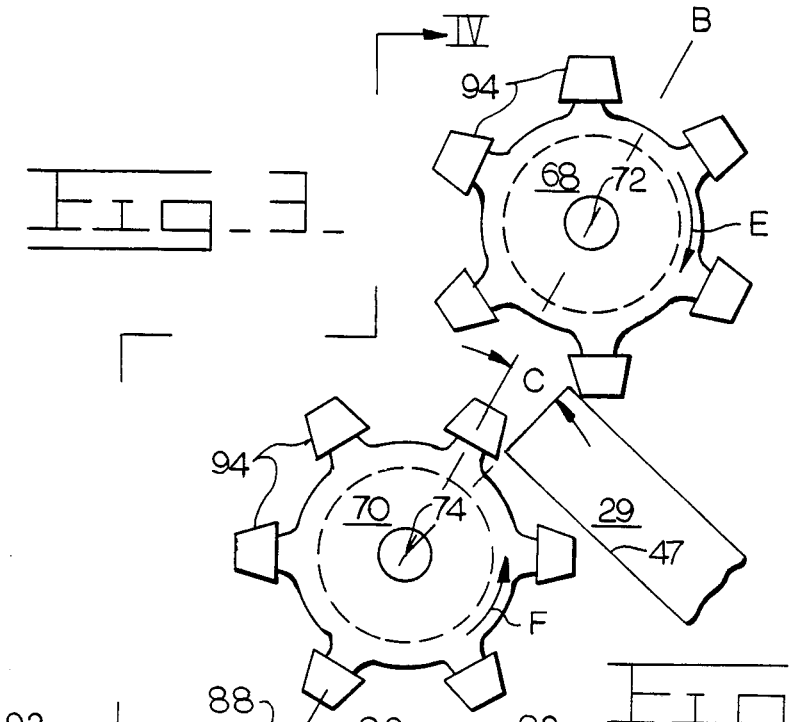
FIG. 3 is an enlarged side elevation view of a portion of the asphalt processor.
Figure 4:
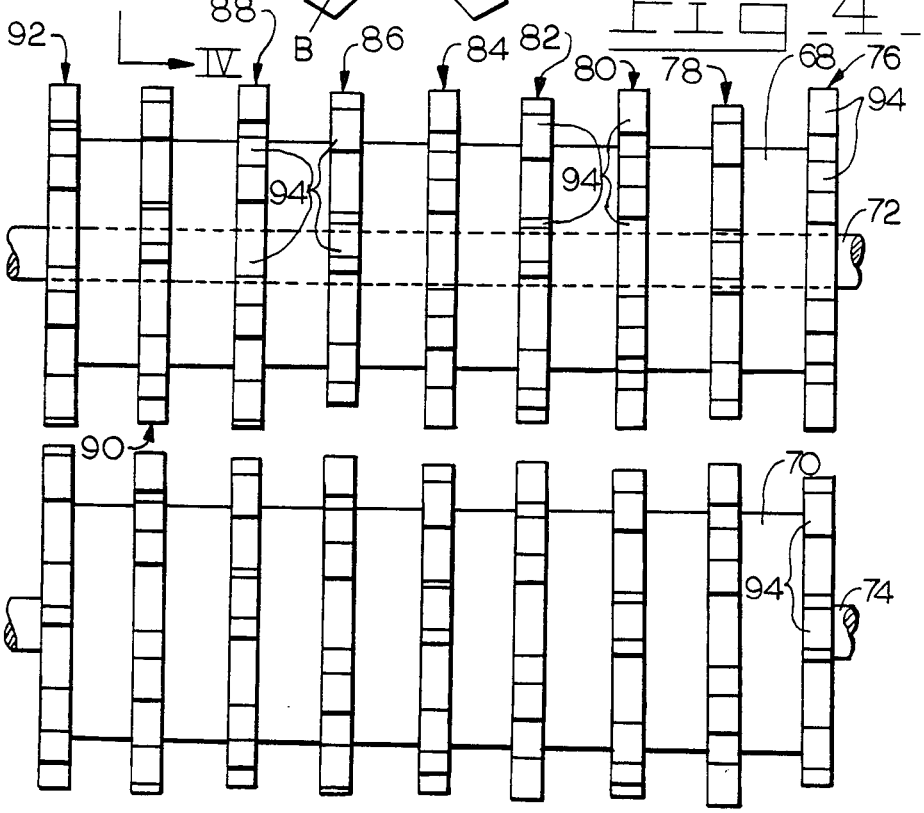
FIG. 4 is a rear elevation view of the apparatus illustrated in FIG. 3 as taken along line IV—IV.

The breaker means 32 includes a pair of generally cylindrical breaker drums 68 and 70 which are respectively rotatable on the frame 20 about laterally oriented axes 72 and 74. Insofar as the breaker drums 68 and 70 are alike, only the upper breaker drum 68 will be described hereinafter with reference made to the breaker drum 70 only to the extent that its orientation is different and its components cooperate with those of the upper drum 68. Enlarged views of the breaker drums 68 and 70 are illustrated in FIGS. 3 and 4. In FIG. 4 it may be seen that the drums each include a plurality (9 rows in this case) of laterally separated circumferential rows 76,78,80,82,84,86,88,90, and 92 of generally radially directed teeth 94, while in FIG. 3, for purposes of simplicity, only row 76 is illustrated. In the illustrated embodiment, each circumferential row includes six teeth 94 which are arcuately equally spaced about each drum 68 and 70 with the teeth 94 in laterally adjacent rows on each drum being arcuately offset 33.33 degrees. As best illustrated in FIGS. 2 and 4, each circumferential row of teeth 94 on the drum 68 is laterally aligned with a circumferential row of teeth on the drum 70, but as illustrated in FIGS. 1 and 3, the teeth in each circumferential row on the drum 68 are circumferentially offset relative to the teeth 94 residing in the row laterally aligned therewith on the other drum 70 in that those teeth 94 on the opposing drums 68 and 70 occupy different arcuate positions relative to the connecting centerline BB between the drums 68 and 70. The breaker drums 68 and 70 are longitudinally offset relative to the approaching asphalt ribbon 29 (or a plane perpendicular to the support surface 47) by an angle "C" as best defined in FIG. 3. The phase relationship of the teeth on the drums 68 and 70 is a function of the aforementioned circumferential and longitudinal offsets and, in the illustrated embodiment, may be characterized as being "out-of-phase." To maintain the out-of-phase relationship between the teeth 94, the breaker drums 68 and 70 are synchronously driven (drive means not shown). In other words, the teeth 94 on the drums 68 and 70 are never directly opposed to one another on opposite sides of the asphalt ribbon 29. The diameter of each breaker drum 68,70, the circumferential offset of the teeth 94, and the longitudinal offset of the drums C are, by example, 26.9 inches, 30°, and 13.5°, respectively.

The conveyor structure 18 generally includes a pair (only one is shown) of conveying belt idlers 96, a conveying drive roller (not shown) located at the discharge end of the conveyor, and an endless belt structure 98 entrained thereabout. The conveying idlers 96 are rotatably supported by the frame 20 and are driven by external means to move the surrounding belt structure 98 and carry away the asphalt fragments.

The asphalt fragmenter 16 is supported at its forward end by a rotatable gauge wheel 100 which is disposed on one lateral side of the frame 20 and is pivotally attached to the frame 20 about an axis 102 by a gauge wheel arm 104. A hydraulic cylinder 106, or other displacement means, is pivotally connected at opposite ends to a lifting lever 108 which is attached to the frame 20 and to the gauge wheel arm 104. A supporting wheel 110 is rotatably supported by the frame 20 at a longitudinally rearward position relative to the gauge wheel 104 preferably on the opposite lateral side of the frame 20 in supporting relation with the conveyor structure 18, as best seen in FIGS. 1 and 2.

INDUSTRIAL APPLICABILITY

The illustrated asphalt processor 10 is designed to process a partial width of an asphalt-surfaced road. Therefore, the processor 10, as pictured in FIG. 1, is intended to make successive passes, each being progressively laterally further into the paper of FIG. 1 than the preceding one. Consequently, the near lateral side of the asphalt layer 24 is always well-defined but the far lateral side of each pass must be clearly delineated to define the asphalt ribbon 29 to-be-processed during that pass and minimize lateral side crumbling during asphalt layer separation from the base 26. The coulter 31 provides such delineation by partially penetrating the asphalt layer 24 to define an edge of the asphalt ribbon 29 and promote lateral separation of the ribbon from the remaining, unprocessed asphalt layer 24. The gauge wheel 100 and the coulter 31 can be disposed on and connected to the near side of the frame 20 if the orientation of the processor 10 on the vehicle 12 or the sequence of processor passes differ from that illustrated.

Through vertical adjustment of the gauge wheel 100 by appropriate displacement of the adjustment cylinder 106, the motor grader 12 or other propulsion means moves the separation member 34 along the interface "A" between the asphalt ribbon 29 and base 26 to separate same. The serrated leading edge 36 permits granular and unwanted base material which adheres loosely to the asphalt ribbon 29 to pass through the longitudinal recesses **36*a* to be redeposited on the base layer 26**.

Subsequent to each separation, the asphalt ribbon 29 is simultaneously elevated and longitudinally transported in the direction "D" in serial fashion by the ramp surface 38 and the elevating structure 40. During the separation and uplifting of the asphalt ribbon 29 inclinably up the ramp surface 38 and elevating structure 40 from its in situ position, the constraining structure 35 exerts a biasing force on the asphalt ribbon 29 toward the ramp 38 and elevating structure 40 to maintain a substantially constant cross-sectional area through which the asphalt ribbon travels. Maintenance of such cross sectional travel area insures a substantially constant flux of asphalt material traveling up the ramp surface 38 and elevating structure 40 and prevents separated surcharges of asphalt from entering and stalling the asphalt breaker drums 68 and 70. While the constraining structure 35, as a whole, is only needed when the asphalt in the ribbon 29 is in substantially spent condition or is otherwise susceptible to crumbling upon layer separation, a constraining element such as the drive roller 50 is needed at the end of the elevating structure 40 for guiding the asphalt ribbon 29 into and insuring proper registry with the breaker drums 68 and 70.

After longitudinally exiting the elevating structure 40, the asphalt ribbon 29 is directed into the breaker means 32 between the breaker drums 68 and 70 which are, as illustrated in FIG. 3, rotating in opposite circumferential directions "E" & "F", respectively, so as to tend to draw the asphalt ribbon 29 between them. The illustrated breaker drums 68 and 70 have a preferable offset "C", as defined in FIG. 3, of approximately 13.5° which enables the breaker means 32 to handle a wider variation in thickness of asphalt material than if the offset was 0°. It is, however, to be understood that such crusher drums could have 0° or even a negative offset.

Figure 5:
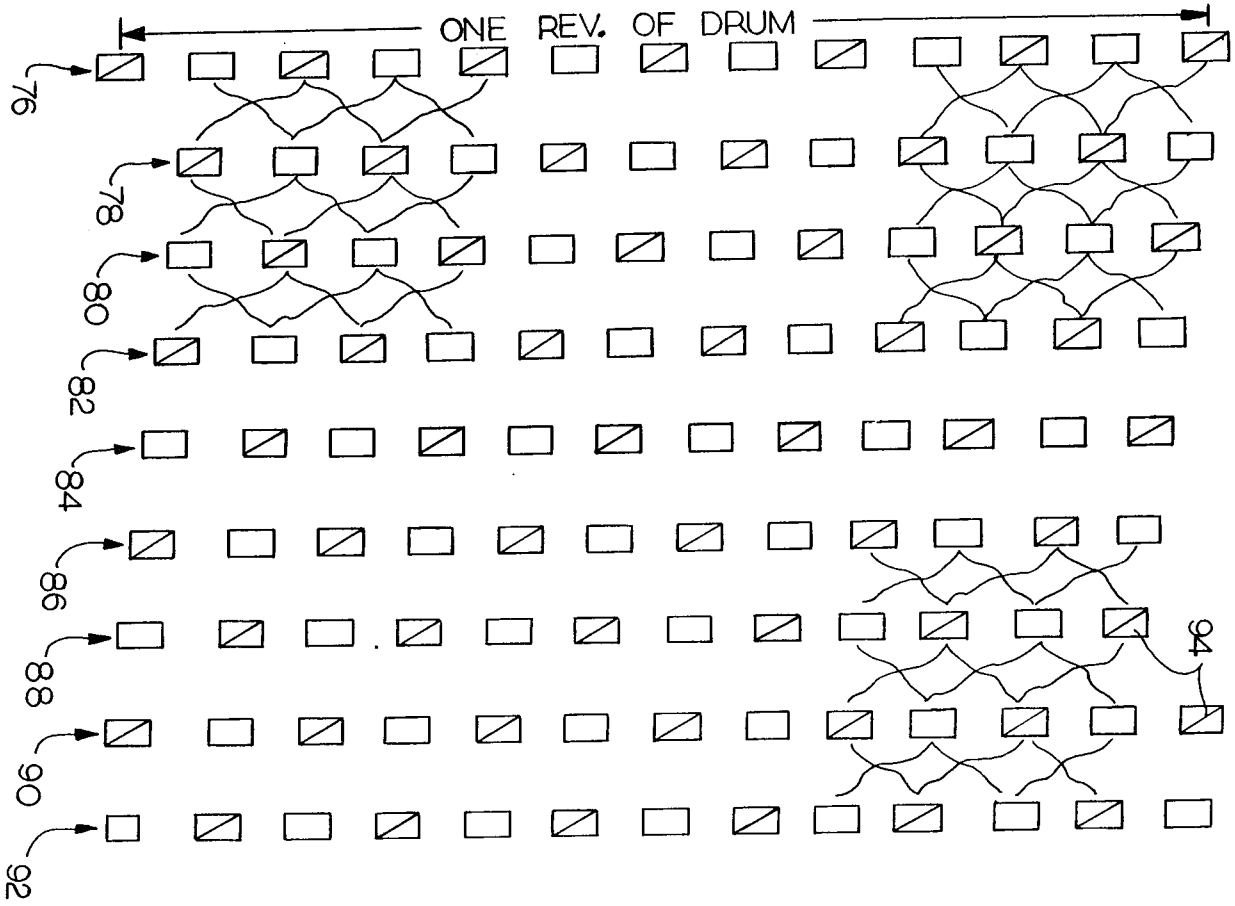
FIG. 5 is a schematic breakage pattern map of the asphalt layer as it is processed in the asphalt processor.

The cooperative breaking action of the drums 68 and 70 will be best understood by referencing FIG. 5 which provides a schematic map of an exemplary fracturing sequence. The teeth 94 resident on drums 68 and 70 are diagrammatically indicated by cross-hatched and plain rectangles, respectively. In the exemplary fracturing sequence in which the asphalt ribbon 29 is moving in the "D" direction, a tooth 94 residing on the drum 68 in the circumferential row 76 first engages the asphalt ribbon 29. The next tooth 94 to engage the asphalt ribbon resides on the drum 70 in the row 78 and is followed by a tooth 94 residing on the drum 68 in the row 80. It may be seen that the asphalt ribbon 29 is sequentially engaged by teeth 94 residing on alternating drums 68 and 70 and in laterally adjacent rows 76–92. Sequential tooth engagement occurs every 3.75° of rotation for both drums 68 and 70 (every 7.5° for each drum) and traverses simultaneously in a lateral and circumferential direction "across" and "around" the drums 68 and 70. A second tooth engagement traversal across and around the drums 68 and 70 begins with engagement of the asphalt ribbon 29 by a tooth 94 residing on the drum 70 in the row 76 and occurs simultaneously with the end of the first traversal across and around the drums 68 and 70 wherein the asphalt ribbon 29 is engaged by a tooth 94 residing on the drum 68 in the row 92. Due to the odd number (9 in this case) of circumferential rows 76–92, the longitudinal breakage pattern for each circumferential row is completed every sixty degrees of drum rotation and occurs in repeating fashion every two traversals of the asphalt engagement sequence across the drums 68 and 70. The 7.5° arcuate offset of teeth 94 in laterally adjacent rows and the alternate engagement of the asphalt ribbon 29 by the teeth resident on the drums 68 and 70 respectively provide substantially uniform power consumption for all rotational positions of each drum and substantially equal power consumption for both drums. Uniformalizing the power consumption avoids the large peak loads which are characteristic for drums equipped with laterally aligned teeth and permits the size of the components in the breaker means 32 to be minimized. It is to be understood that the aforementioned fracturing sequence is illustrative only, and that actual tooth engagement with the asphalt ribbon 29 may begin at any point in the sequence depending upon the arcuate positions of the drums when the asphalt ribbon 29 passes between them.

The rotation of the breaker drums 68 and 70 and attached teeth 94 provide cooperative engagement of the teeth 94 with the asphalt ribbon 29 and induce bending/flexure failures in the ribbon 29 in opposite transverse directions "G" and "H" (FIG. 6). In the illustrated case, the bending failures result in fragments of approximate diamond shape (FIG. 5) having a longitudinal dimension of approximately 7 inches and a lateral width of about 6 to 12 inches across the corners. For purposes of simplicity and clarity, only some of the lines of breakage have been illustrated between teeth in FIG. 5. Although operation of the breaker means 32 has been illustrated and described along any circumferential row as utilizing one tooth 94 from one drum 68 or 70 for engaging one surface of the asphalt ribbon 29 longitudinally between engagement locations of two teeth 94 resident on the other drum 68 or 70, it is to be understood that the invention finds equal advantage where one surface of the asphalt ribbon 29 is engaged by the support structure 30 and one tooth on one drum 68 or 70 at separate engagement locations and the other surface of the asphalt ribbon 29 is engaged between those engagement locations by one tooth resident on the other drum 68 or 70.

Figure 6A:
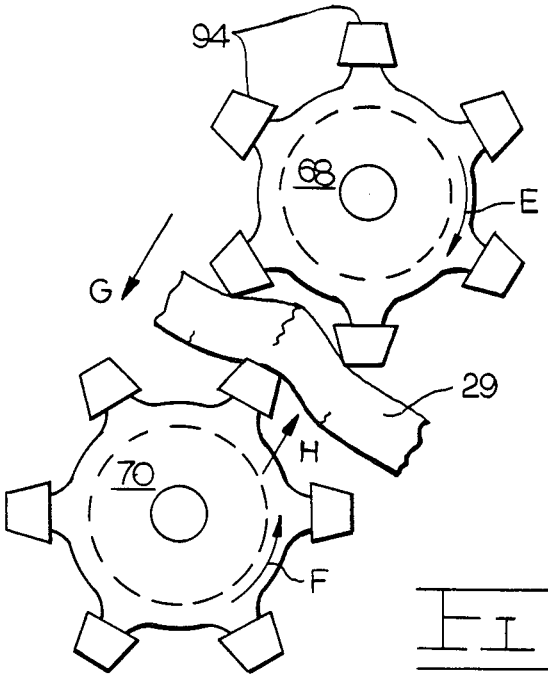
FIGS. 6A & 6B are sequential illustrations of how an asphalt ribbon proceeds through the processor illustrated in FIG. 3.
Figure 6B:
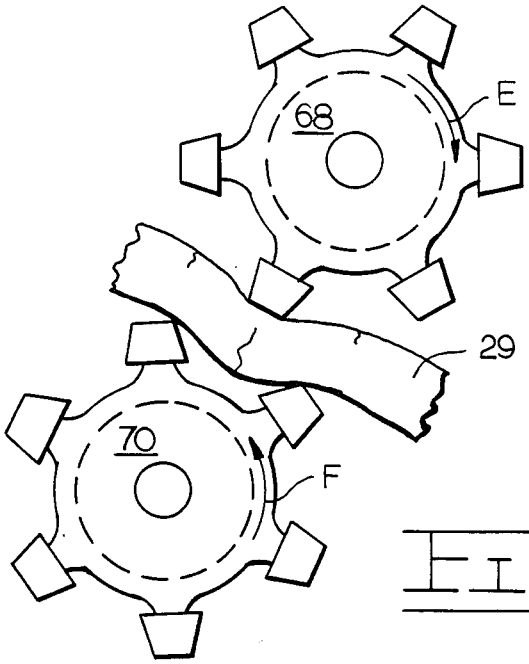

For purposes of clarifying the fracture mode of fragmenting the asphalt ribbon 29, only teeth 94 residing in the corresponding laterally aligned rows 76 on opposite crusher drums 68 and 70 are illustrated in FIG. 6A and FIG. 6B. In FIG. 6A the asphalt ribbon 29 is engaged on one surface at longitudinally separated locations by two teeth 94 resident on the breaker drum 70 and on the opposed ribbon surface at a site between the separated locations by one tooth 94 resident on the breaker drum 68. FIG. 6B illustrates an asphalt ribbon fracture in which the drums 68 and 70 have rotated from their illustrated portions in FIG. 6A such that in FIG. 6B two teeth 94 and one tooth 94, respectively resident on the drums 68 and 70, are in fracturing engagement with the ribbon 29's opposite surfaces. As was the case in FIG. 6A, FIG. 6B shows the single tooth's engagement with the ribbon 29 being between the engagement locations of the opposing two teeth 94. In FIGS. 6A and 6B the teeth resident on the breaker drums 68 and 70 respectively displace the ribbon 29 in opposite transverse directions "G" and "H" to reduce the ribbon 29 to fragments of desired dimension by inducing bending failures therein. The resulting asphalt fragments exit the breaker apparatus 16, fall onto the elevating conveyor structure 18, and are deposited into a haulage vehicle (not shown) or other asphalt processing apparatus (not shown).

To ensure against plugging or jamming any portion of the processor apparatus 10, the tangential tip speed of teeth 94 should be at least as fast as the speed with which the separating member 34 is advanced along the interface "A". The elevating and constraining structures 40 and 35 should have surface speeds at least as great as the advancement speed of the separating member 34 to allow the feeding of debris or slabs that may be deposited on top of the ribbon 29. Moreover, the tangential tip speed of the teeth 94 should vary with the quantity of material entering breaker means 32 but should not exceed approximately 2 times the advancement speed of the separating member 34 since the present invention relies on large torque and low speed for a given horsepower as contrasted with typical roll crushers which rely on high speed and low torque.

It should now be apparent that an improved method and apparatus have been provided for stripping an asphalt ribbon 29 from an underlying base 26, elevating that asphalt ribbon 29 to a suitable processing height, and efficiently fragmenting the elevated asphalt ribbon in a bending/flexure mode failure. It has been determined through testing and analysis that an asphalt processor apparatus 10 utilizing such fracturing method with a secondary crusher consumes approximately one-third the power that profile/milling machines consume per unit of material per unit of time with less wear of asphalt engaging components. The actual parameters of the crusher drum's size, number of teeth, offset angle, and centerline distance between drums are complex functions of the degree of cohesion of the asphalt binder, the temperature of the asphalt, the aggregate size of the asphalt, the binder composition of the asphalt layer, and the expected variation in lateral and longitudinal thickness of the asphalt ribbon 29. Even though the aforementioned asphalt properties vary widely as does the size and relationship of the processor components for optimally handling asphalt having those properties, it is only necessary, for purposes of the present invention, that the asphalt ribbon 29 be supported on one surface at two separated locations such as by teeth 94 and on the opposite surface at a third location such as by a tooth 94 intermediate the two separated locations to effect the bending, flexure fragmenting thereof. It is, accordingly, only necessary that the teeth 94 in laterally aligned rows on the opposing drums 68 and 70 not engage opposing surfaces of the asphalt ribbon 29 immediately opposite one another such as directly along the centerline BB.

We claim:

1. An apparatus for removing a ribbon of asphalt from an underlying base and fracturing the asphalt ribbon into fragments of predetermined size, said apparatus comprising:

means for separating an asphalt ribbon from laterally adjacent asphalt and from the underlying base;

means for guiding and elevating the asphalt ribbon to a predetermined height; and means for displacing the asphalt ribbon after said predetermined height in opposite transverse directions at longitudinally and laterally separated locations and bendingly fracturing the asphalt ribbon into fragments of predetermined size.

2. The apparatus of claim 1, wherein said transverse displacing means includes:

a plurality of fracturing teeth disposable on and engageable with upper and lower opposite sides of the asphalt ribbon at the separated locations, said oppositely disposable fracturing teeth being respectively displaceable in the opposite transverse directions.

3. An apparatus for processing an asphalt ribbon, said apparatus comprising:

means for stripping the asphalt ribbon from an underlying base;

means for displacing the stripped asphalt ribbon in a transverse direction at one longitudinal location; and means for restraining movement of the stripped asphalt ribbon in said transverse direction at two separated longitudinal locations, said two locations being on opposite sides of the one location.

4. The processing apparatus of claim 3, wherein said stripping means includes:

a cutting member having a leading edge insertable between the asphalt ribbon and base.

5. The processing apparatus of claim 3, including:

support structure for guidably elevating the stripped ribbon to a predetermined height, said support structure having a support surface which is generally upwardly sloped in the longitudinal direction.

6. The processing apparatus of claim 5, including:

a constraining structure having a constraining surface which is engageable with a second surface of said asphalt ribbon, said constraining surface being generally parallel to said support surface.

7. The processing apparatus of claim 6, including:

means for biasing said constraining surface toward said support surface.

8. The processing apparatus of claim 5, including:

an elevating structure having a pair of longitudinally separated, generally circular, rotatable members and an endless structure entrained about and coupled to said circular members, said endless structure constituting said support surface.

9. The processing apparatus of claim 5, wherein said displacing and restraining means includes:

a pair of rotatable, generally cylindrical breaker drums disposed on opposite sides of an intervening plane which is arranged generally parallel to said support surface, each of said drums having parallel laterally directed axes of rotation; and a plurality of generally radially directed teeth mounted on each breaker drum.

10. The processing apparatus of claim 9, wherein said breaker drums are respectively rotatable about the axes in opposite circumferential directions.

11. The processing apparatus (10) of claim 9, wherein a line (BB) connecting the axes of rotation (72, 74) of said breaker drums (68, 70) is at an acute angle (C) relative to a plane which is perpendicular to the intervening plane and which intersects one of said axes of rotation (72, 74).

12. The processing apparatus of claim 9, including:

means for cutting a predetermined lateral width of the asphalt layer, said width being less than the lateral width of said cylindrical breaker drums.

13. A method for stripping away an asphalt ribbon from an underlying base and fracturing the stripped away asphalt ribbon, said method comprising:

moving a separation member in a longitudinal direction along an interface between the asphalt ribbon and the base;

guiding the separated asphalt ribbon along a support surface in an inclined, longitudinal direction upwardly to a predetermined height; and bending the asphalt ribbon in opposite transverse directions at selected longitudinal locations after said predetermined height.

14. The method of claim 13, including:

constraining movement of the separated asphalt ribbon to the inclined, longitudinal direction.

15. The method of claim 13, wherein said transverse bending includes:

rotating a pair of breaker drums which have protruding teeth and which are disposed on opposite sides of a plane arranged generally parallel to the support surface, said rotating of the drums being at substantially equal velocity in opposite circumferential directions.

16. The method of claim 15, wherein the tangential tip speed of said teeth is at least as great as but not more than about two times the speed of the separation member 34 moving along the interface.

17. The method of claim 13, including:

cutting the asphalt at predetermined laterally spaced locations to define the ribbon prior to guiding the separated asphalt ribbon.

18. An apparatus for separating an asphalt layer bonded to a base layer and fracturing the asphalt layer, said apparatus comprising:

means for longitudinally cutting the asphalt layer at a lateral location;

means for severing the layer-to-layer bond along a line between two laterally spaced locations and defining an asphalt ribbon;

means for guiding and elevating the asphalt ribbon to a predetermined height; and means for alternately diverting and fracturing the guided asphalt ribbon in opposite transverse directions at a plurality of longitudinal locations along a plurality of laterally spaced longitudinal lines, said longitudinal locations in laterally adjacent lines being longitudinally offset.

19. An apparatus (10) for stripping a predetermined lateral width ribbon (29) of an asphalt layer (24) from a base layer (26) and fracturing same comprising:

a frame (20);

means (28) for longitudinally cutting the asphalt layer (24) at predetermined lateral locations;

a separating member (34) supported on the frame (20) and having a leading edge (36) which is insertable between the asphalt layer (24) and the base layer (26) to sever the bond therebetween, said leading edge (36) having lateral width which is substantially equal to the distance between adjacent lateral locations;

a ramp surface (38) inclined in the longitudinal direction and supported by the frame (20), said ramp surface (38) being longitudinally adjacent said separating member (34);

a pair of breaker drums (68,70) rotatable in opposite circumferential directions (E,F) about laterally disposed axes (72, 74), said breaker drums (68,70) being longitudinally adjacent said ramp surface (38) and on opposite sides of a plane parallel to said ramp surface (38); and a plurality of teeth (94) radially attached to each breaker drum (68,70), said teeth (94) in any plane perpendicular to said rotation axes (72,74) and resident on different breaker drums (68,70) being circumferentially offset relative to a centerline (BB) connecting the axes (72,74).

* * * * *